US006500028B1

(12) United States Patent
Higuchi

(10) Patent No.: US 6,500,028 B1
(45) Date of Patent: Dec. 31, 2002

(54) CONNECTOR WITH GROUND PIN FOR BOARDS

(75) Inventor: Kunihiro Higuchi, Hyogo (JP)

(73) Assignee: J. S. T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/763,765

(22) PCT Filed: Jun. 28, 2000

(86) PCT No.: PCT/JP00/04236

§ 371 (c)(1),
(2), (4) Date: Feb. 27, 2001

(87) PCT Pub. No.: WO01/03246

PCT Pub. Date: Jan. 11, 2001

(30) Foreign Application Priority Data

Jun. 30, 1999 (JP) ..... 11-185887

(51) Int. Cl.[7] ..... H01R 13/648
(52) U.S. Cl. ..... 439/607; 439/567; 439/571
(58) Field of Search ..... 439/607, 567–569, 439/571

(56) References Cited

U.S. PATENT DOCUMENTS

| | | | | | |
|---|---|---|---|---|---|
| 4,795,353 | A | * | 1/1989 | Baker | 439/92 |
| 4,824,398 | A | * | 4/1989 | Taylor | 439/557 |
| 4,865,555 | A | * | 9/1989 | Assini et al. | 439/567 |
| 4,889,502 | A | | 12/1989 | Althouse et al. | 439/607 |
| 5,085,589 | A | * | 2/1992 | Kan | 439/607 |
| 5,108,312 | A | * | 4/1992 | Sampson | 439/607 |
| 5,163,851 | A | * | 11/1992 | Hart et al. | 439/607 |
| 5,407,364 | A | * | 4/1995 | Tzeng et al. | 439/567 |
| 5,738,541 | A | * | 4/1998 | Tseng | 439/567 |
| 5,820,393 | A | * | 10/1998 | Edgley et al. | 439/567 |
| 6,109,961 | A | * | 8/2000 | Chen et al. | 439/567 |

FOREIGN PATENT DOCUMENTS

| | | | | |
|---|---|---|---|---|
| GB | 2335315 | * | 9/1999 | 439/567 |
| JP | 1-63082 | | 4/1989 | |
| JP | 2-12175 | | 1/1990 | |
| JP | 3-24284 | | 3/1991 | |
| JP | 6-17130 | | 3/1994 | |
| JP | 7-335333 | | 12/1995 | |
| JP | 9-35782 | | 2/1997 | |
| JP | 11-67368 | | 3/1999 | |

* cited by examiner

*Primary Examiner*—P. Austin Bradley
*Assistant Examiner*—Briggitte R. Hammond
(74) *Attorney, Agent, or Firm*—Rader, Fishman & Grauer PLLC

(57) ABSTRACT

A connector with ground pin for boards includes an insulative connector body (4), and an electromagnetic shielding shell (9) covering a surface of the connector body (4). A ground pin (22) fixed to the connector body (4) has electrical conductivity with the shell (9). A cylindrical lock portion (25) of the ground pin (22) is inserted through a mounting hole (21) of a circuit board (20). The lock portion (25) resiliently engages the mounting hole (21) substantially on its overall circumference, thereby stably tacking the connector to the board (20). A solder build-up is formed substantially along the overall circumference of the lock portion (25).

17 Claims, 6 Drawing Sheets

CONNECTOR WITH GROUND PIN FOR BOARDS

TECHNICAL FIELD

The present invention relates to a connector having a ground pin for boards for providing grounding connection in a circuit board.

BACKGROUND ART

There has been provided a connector of this type which is fixed to a board by tacking the connector to the board by way of a ground pin of the connector inserted in a mounting hole of the board, and then soldering a distal end of the ground pin to a back side of the board (see, for example, Japanese Unexamined Utility Model Publication No.1(1989)-63082).

In this connector, however, the ground pin is screw-held to a metallic shell and therefore, an increased number of assembly steps and increased production costs result. The distal end of the ground pin comprises a nib-like claw, which is only capable of engaging a part of an inner periphery of the mounting hole when inserted therein. Therefore, the connector is tacked to the board in such an unstable manner that the connector may be dislocated relative to the board. If the dislocated connector is soldered to the board, the soldered portion is prone to receive an excessive force during the use of the connector. This leads to a problem of the durability of the fixed portion. Furthermore, a positive fixing cannot be ensured because a solder build-up can be formed only on opposite side edges of the claw.

There is provided an alternative connector arranged such that the ground pin formed integrally with the shell has a semi-circular section and that the ground pin is soldered to the boards substantially along a semi-circumference of the mounting hole (see, for example, Japanese Unexamined Patent Publication No.9(1997)-35782). In this case, the fixing strength at which the connector is soldered to the board is somewhat increased but not to a sufficient degree.

By the way, the connector of this type includes a locked member having a snag portion adapted to be locked to an engagement portion of a counterpart connector when this connector is coupled to the counterpart connector in paired relation.

When the counterpart connector is pulled out, the locked member is subject to such a great load that the locked member may sometimes be bent. Therefore, a high strength is required of the locked member.

In this connection, there is provided a connector wherein the locked member is formed integrally with the connector body by die-casting (see, for example, Japanese Unexamined Patent Publication No.7(1995)-335333). However, this method involves high production costs. Furthermore, a screw is used for fixing the connector to the board and hence, the increased number of assembly steps results in increased production costs.

On the other hand, there is provided a connector wherein the ground pin is formed integrally with the locked member by sheet metal (see, for example, Japanese Unexamined Utility Model Publication No.2(1990)-12175). In the case of the one-piece construction, however, the following disadvantages exist although the production costs can be reduced. Specifically, the locked member is required of high rigidity such as to withstand the pulling load from the counterpart connector while on the other hand, the ground pin is required of high resilience in the light of mountability to the mounting hole. Hence, in the case of the one-piece construction, it is quite difficult to satisfy the both requirements of the high strength of the locked member and the mountability of the ground pin. Furthermore, this connector is arranged such that the locked member, snag portion and ground pin are substantially aligned on one straight line. This leads to a fear that the pulling load applied to the snag portion directly acts on the ground pin, resulting in the breakage of the solder around the ground pin.

In view of the foregoing, the present invention has been accomplished. An object of the invention is to provide a connector with ground pin for boards which assumes a stable position when tacked to the boards and is capable of being readily and rigidly fixed to the board.

DISCLOSURE OF THE INVENTION

For achieving the above object, a preferred mode of the invention comprises an insulative connector body accommodating a plurality of contacts; an electromagnetic shielding shell partially covering a surface of the connector body; and a ground pin fixed to the connector body as having electrical conductivity with the shell, wherein the ground pin includes a cylindrical lock portion resiliently deformable in radial direction so as to be inserted through and locked to a mounting hole of a circuit board, and wherein the lock portion resiliently engages the mounting hole substantially on its overall circumference when inserted through the mounting hole.

In this embodiment, the ground pin is tacked to the board by way of the resilient engagement between the lock portion inserted in the mounting hole of the board and the mounting hole. At this time, the tacked connector is less liable to totter because the connector engages an almost entire periphery of the mounting hole. Particularly where the board in an inclined position is subject to a soldering process, the connector can be tacked thereto in a stable manner. Furthermore, the ground pin can be positively fixed to the board because a solder build-up can be formed substantially along the overall periphery of the cylindrical lock portion inserted in the mounting hole of the board.

BEST MODES FOR CARRYING OUT THE INVENTION

Preferred embodiments of the invention will be described with reference to the accompanying drawings.

Figure 1A:
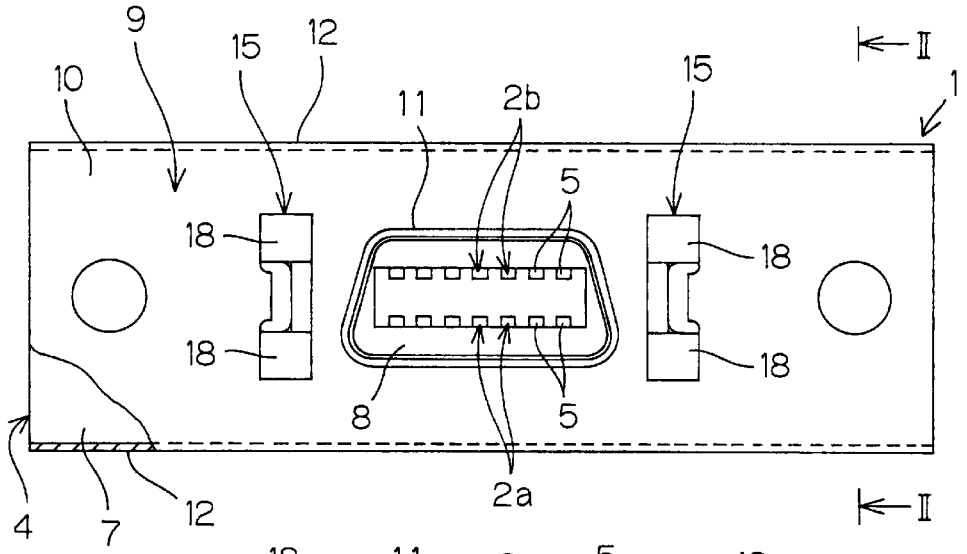
FIGS. 1A–1B are a plan view and a partially broken away side view showing a connector with ground pin according to a first embodiment of the invention.
Figure 1B:
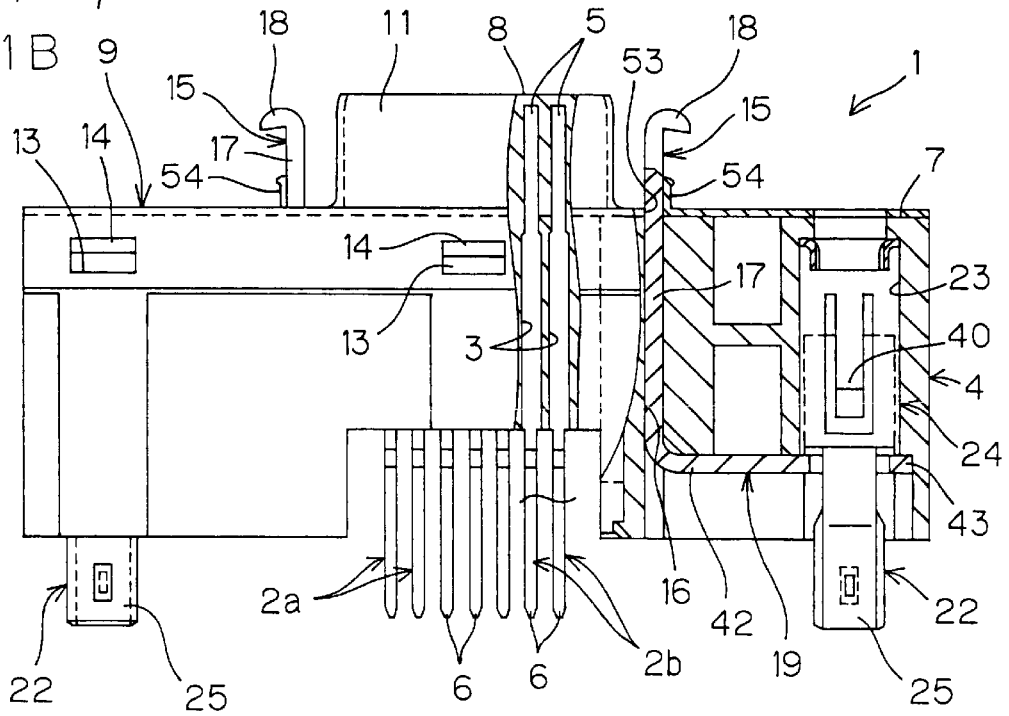

FIGS. 1A and 1B are a plan view and partially broken away side view showing a connector with ground pin for boards according to a first embodiment of the invention. Referring to the figures, the connector 1 with ground pin for boards (hereinafter, simply referred to as "connector 1") is an electrical connector of a so-called face-to-face connection type, which includes a plurality of contacts 2*a*, 2*b* arranged in two arrays and a connector body 4 fixably retaining the respective contacts 2*a*, 2*b* in individual contact receiving holes 3 in a manner to isolate the contacts from one another. The contacts 2*a*, 2*b* have respective first ends 5 thereof contacted with contacts of a counterpart connector (not shown) while having respective second ends 6 thereof, serving as leads, connected to a conductor on a board by means of, for example, solder.

The connector body 4 is formed of an insulative member such as plastic. The connector body includes a coupling surface 7 to a counterpart connector in paired relation, and a cylinder portion 8 substantially of a rectangular shape, which projects from a central portion of the coupling surface 7 for accommodating the first ends 5 of the plural contacts 2.

Outer surfaces of the coupling surface 7 and cylinder portion 8 of the connector body 4 are covered with a metallic shell 9 for electromagnetic shielding. The shell 9 includes a base 10 covering the coupling surface 7, a cylindrical portion 11 upstanding from the base 10 to cover the outer surface of the cylinder portion 8 of the connector body 4, and lateral-edge portions 12 folded down along lateral side edges of the base 10. A locking projection 14 of the connector body 4 is fitted in a lock hole 13 defined in each of the lateral-edge portions 12, whereby the shell 9 is secured to the connector body 4.

A pair of locked members 15 partially project from places on opposite sides of the cylinder portion 8 on the coupling surface 7 of the connector body 4, the locked members serving to lock the connector 1 in connection with the counterpart connector when the connector 1 is coupled to the counterpart connector.

The locked member 15 includes an arm 17 fixably press-inserted in a first support hole 16 of the connector body 4. The arm 17 includes a hook-like snag portion 18 at its distal end, the snag portion adapted to be locked to an unillustrated engagement portion disposed at the counterpart connector. The snag portions 18 of the pair of the locked member 15 are in mutually opposite orientations and oriented outward. The arm 17 projects outside, extending through an opening 53 of the shell 9 continuous to the support hole 16. A resilient contact piece 54 of a substantially L-shaped sectional shape is extended from a circumferential edge of the opening 53, thereby ensuring electrical conductivity between the shell 9 and the locked member 15.

Figure 2:
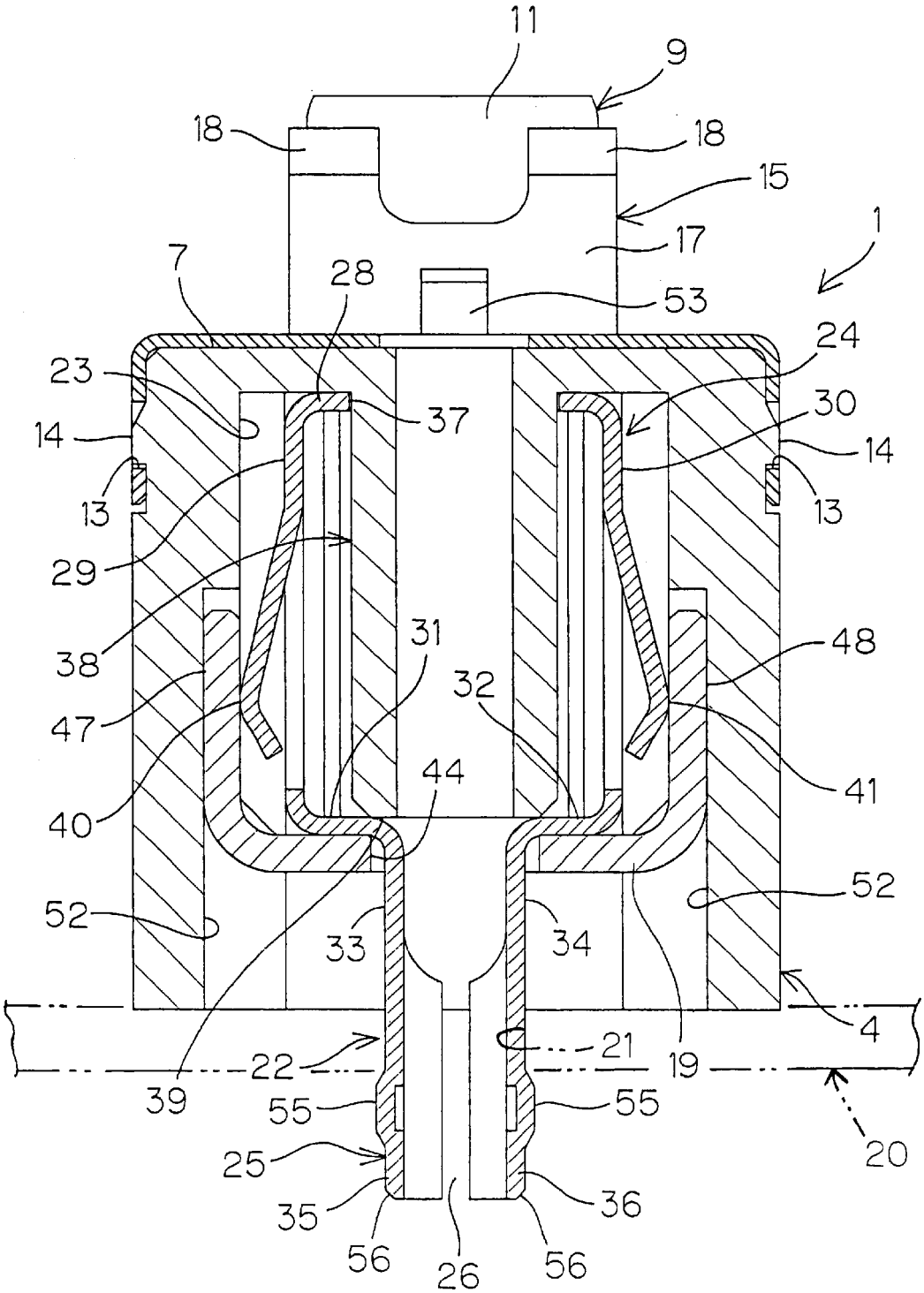
FIG. 2 is a sectional view taken on the line II—II in FIG. 1A.
Figure 4A:
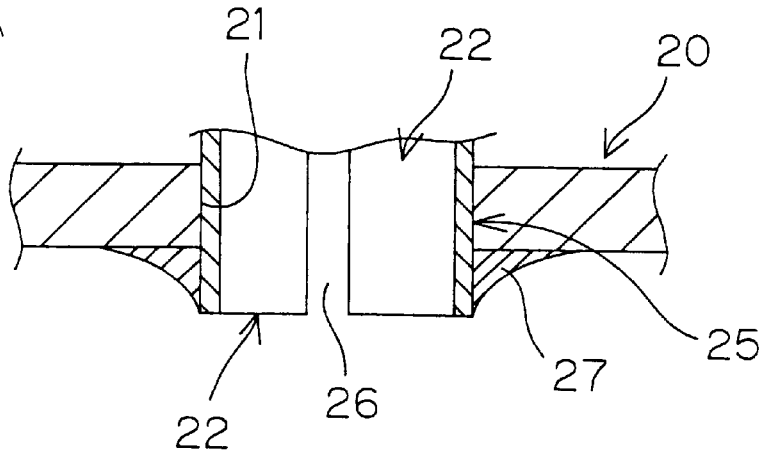
FIG. 4A is a schematic vertical sectional view showing the ground pin and a board.

The arm 17 of the locked member 15 extends orthogonally from a first end 42 of a seat portion 19 extended in parallel to the coupling surface 7. The seat portion 19 serves to fix a ground pin 22 in a second support hole 23 of the connector body 4 as shown in FIGS. 1A–1B and 2, the ground pin 22 inserted through a mounting hole 21 of the board 20, as shown in FIG. 4A. The ground pin 22 includes a main body 24 retainably received by the second support hole 23, and a lock portion 25 extended from the main body 24 and used for tacking and soldering.

Figure 3:
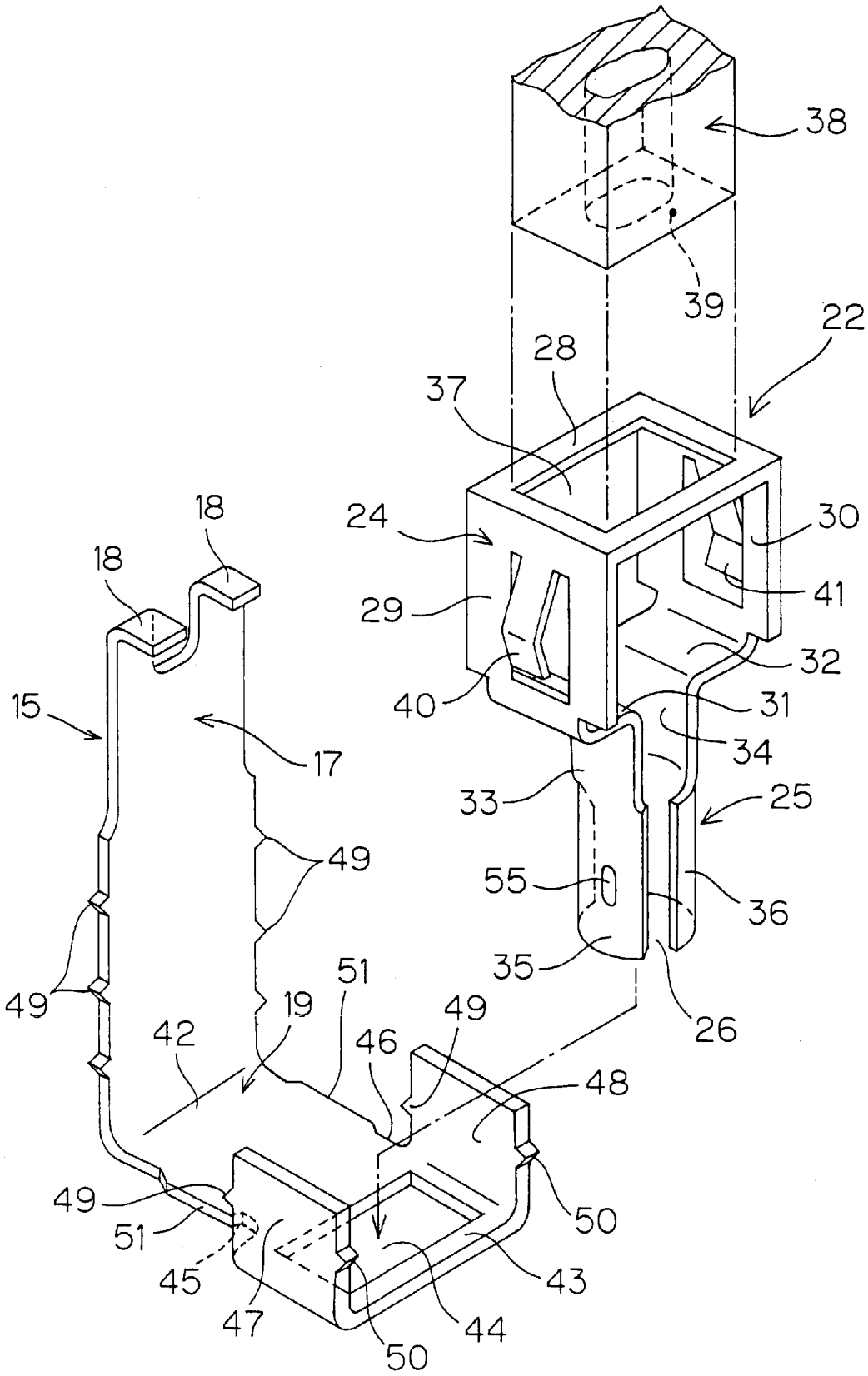
FIG. 3 is an exploded perspective view showing the ground pin, a locked member and a column portion of a connector body.
Figure 4B:
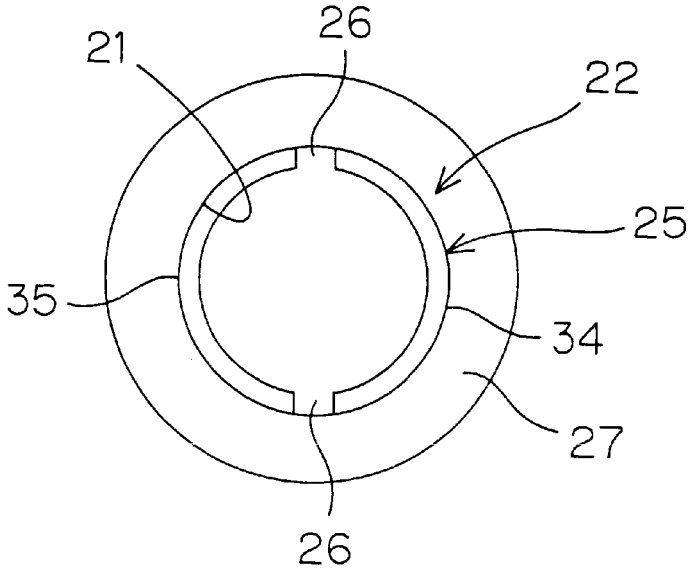
FIG. 4B is a bottom end view showing the ground pin and board.

As shown in FIGS. 2 and 3, the lock portion 25 is shaped like a cylinder with a slot 26. In a state inserted through the mounting hole 21 of the board 20, the lock portion 25 is allowed to resiliently distend in diameter to engage substantially the overall periphery of the mounting hole 21, as shown in FIGS. 4A and 4B, thereby stably tacking the connector 1 to the board 20. This arrangement is particularly advantageous in that the lock portion is capable of stably tacking the connector 1 to the board 20 when the board 20 in an inclined position is subjected to soldering. In addition, a solder build-up 27 can be formed substantially along the overall circumference of the cylindrical lock portion 25 and hence, it is ensured that the ground pin 22 is positively fixed to the board 20.

Next, the ground pin 22 and the locked member 15 will be described with reference to FIGS. 1A–1B, 2 and 3. As shown in FIGS. 2 and 3, the ground pin 22 is constructed from a sheet of metal which is worked into shape. The main body 24 includes an upper-plate portion 28, lateral side-wall portions 29, 30, and inward flanges 31, 32 extended from respective bottoms of the sidewall portions 29, 30. Extension pieces 33, 34 are extended orthogonally downward from opposite ends of the flanges 31, 32. Lower half portions of the extension pieces 33, 34 are curved into curved portions 35, 36 of a substantially semi-circular section, respectively, which constitute the cylindrical lock portion 25 with a pair of slots 26.

A reference character 55 represents a vertical hollow rib projecting outward from each of the curved portions 35, 36. A reference character 56 represents a taper portion defined at the respective curved portions 35, 36 such that the curved portions are tapered at their distal ends. The provision of the taper portions 56 facilitates insertion of the lock portion 25 into the mounting hole 21.

Referring to FIG. 2, the lock portion 25 is temporarily reduced in diameter when the vertical ribs 55 are passed through the mounting hole 21 of the board 20. Subsequently, with the vertical ribs 55 guided out of the mounting hole 21, the lock portion 25 resiliently distends in diameter, thus engaging a circumferential edge of the mounting hole 21 on lower (back) side of the board. In this state, the board 20 is clamped between the vertical ribs 55 and the lower side of the connector body 4 so that the connector 1 can be stably tacked to the board 20.

In addition, a click sound is produced when the vertical ribs 55, passed through the mounting hole 21, comes into engagement with the circumferential edge of the mounting hole. This ensures that a worker can positively recognize that the ground pin 22 is completely inserted in the mounting hole 21 (a so-called tactile feedback indicative of the insertion completion) as well as that the ground pin 22 has accomplished the tacking. It is noted that FIG. 4A omits the illustration of the vertical ribs 55.

Now referring to FIGS. 2 and 3, the upper-plate portion 28 is formed with a rectangular opening 37. A column 38 of a rectangular sectional shape extends downward from a central portion of a bottom (corresponding to a back side of the coupling surface 7) of the second support hole 23 of the connector body 4. The column 38 is inserted between the side-wall portions 29, 30 via the opening 37 of the upper-plate portion 28 while bottom-end surface 39 of the column 38 abuts against the inward flanges 31, 32, thereby positioning the ground pin 22 with respect to a vertical direction of the connector body 4. The side-wall portions 29, 30 are formed with resilient contact pieces 40,41 which are formed by cutting and bending out respective parts of the side-wall portions in a chevron-like fashion.

Turning to FIG. 3, the arm 17 of the locked member 15 is formed with press-fit projections at lateral side edges thereof. The seat portion 19 is formed with a rectangular through-hole 44 near a second end 43 thereof, the through-hole permitting the lock portion 25 of the ground pin 22 to pass therethrough. With the extension pieces 33, 34 including the lock portion 25 inserted through the through-hole 44, as shown in FIG. 2, the inward flanges 31, 32 of the ground pin 22 are pressed against the bottom-end surface 39 of the column 38 by means of a circumferential edge of the through-hole 44 of the seat portion 19.

Referring to FIGS. 2 and 3, the seat portion 19 is formed with a pair of extension plates 47, 48 at lateral side edges 45, 46 in paired relation, the extension plates extended upward from places sandwiching the through-hole 44 therebetween. The extension plates 47, 48 cooperate with the seat portion 19 to define a groove shape. As shown in FIG. 2, the extension plates 47, 48 are inserted along respective wall surfaces of a pair of third support holes 52 and fixed to places, the third support holes 52 disposed on opposite sides of the second support hole 23 as partially communicating therewith. Respective inside surfaces of the extension plates 47, 48 are contacted by the corresponding resilient contact pieces 40, 41 of the ground pin 22 such that the electrical conductivity therebetween is maintained.

Turning to FIG. 3, the extension plates 47, 48 are each formed with press-fit projections 50 at fore and rear edges thereof. The seat portion 19 is also formed with trapezoidal press-fit projections 51 at the lateral side edges 45, 46 of an intermediate portion between the first end 42 of the seat portion and the extension plates 47, 48.

According to the first embodiment, the ground pin is assembled into the connector as follows. The ground pin 22 is inserted in the second support hole 23 from its main body 24 side. Subsequently, the arm 17 and extension plates 47, 48 of the locked member 15 are inserted in the first and third support holes 16, 52, respectively, thereby press-inserting the press-fit portions 49, 50, 51 of the locked member 15 in the corresponding insides of the support holes 16, 52. On the other hand, with the through-hole 44 of the seat portion 19 of the locked member 15 penetrated by the lock portion 25 of the ground pin 22, the seat portion 19 of the locked member 15 is brought into engagement with the main body 24 of the ground pin 22 thereby fixing the main body 24 of the ground pin 22 to the second support hole 23. Thus, the ground pin 22 can be readily assembled into the connector by inserting the main body 24 of the ground pin into the corresponding support hole 23 and then press-inserting the locked member 15 in the corresponding support holes 16, 52.

The assembled ground pin 22 of the connector 1 is tacked to the board 20 by inserting its lock portion 25 into the mounting hole 21 of the board 20 and then allowing the lock portion 25 to diametrically distend so as to come into resilient engagement with the inner periphery of the mounting hole 21. The tacked connector 1 does not totter because the lock portion 25 substantially engages the overall area of the inner periphery of the mounting hole 21. Particularly when the inclined board 20 is subjected to soldering, the connector 1 can be stably tacked to the board 20. Furthermore, the solder build-up 27 can be formed substantially along the overall circumference of the cylindrical lock portion 25 so that the ground pin 22 is positively secured to the board 20.

The locked member 15 for locking the connector in connection with the counterpart connector also serves as a member for fixing the main body 24 of the ground pin 22 to the second support hole 23 of the connector body 4. Therefore, the production costs can be reduced by virtue of the double-duty design of the member.

This embodiment provides a two-piece structure consisting of the ground pin 22 and the locked member 15 serving as the member for fixing the main body 24 of the ground pin 22 to the connector body 4. In this structure, the ground pin 22 employing a thin material of a relatively high resilience can attain such a rebound as facilitates insertion of the ground pin into the mounting hole 21 of the board 20 and suits tacking of the connector. Further, the locked member 15 employing a material of a relatively high rigidity and great thickness for the fixing purpose can positively lock the connector 1 in the connected state.

Furthermore, an action line of a pulling load applied to the locked member 15 by the counterpart connector is spaced away from the ground pin 22 and therefore, a pulling force transferred from the locked member 15 side to the ground pin 22 may be reduced. The locked member 15 for locking the connected state is also used for fixing the ground pin 22 and hence, the production costs are further reduced by virtue of the dual-duty design.

The pulling load applied to the locked member 15 by the counterpart connector acts on the first end 42 of the seat portion 19 whereas the ground pin 22 is retained at place spaced a predetermined distance away from the first end 42 of the seat portion 19. Accordingly, the pulling force transferred from the locked member 15 to the ground pin 22 can be significantly reduced as compared to a case where the ground pin 22 is located on the action line of the aforethe pulling load. Hence, the ground pin 22 is less liable to disengage from the mounting hole 21 of the board 20.

The resilient contact piece 54 extended from the circumferential edge of the opening 53 of the shell 9 resiliently contacts the arm 17, thereby ensuring the conductivity between the shell 9 and the locked member 15. On the other hand, the resilient contact pieces 40, 41 of the ground pin 22 resiliently contact the lateral side-wall portions 47, 48, thereby ensuring the conductivity between the locked member 15 and the ground pin 22. As a result, it is ensured that the electrical conductivity between the shell 9 and the ground pin 22 can be positively established.

The main body 24 of the ground pin 22 is retained by the circumferential edge of the through-hole 44 of the seat portion 19. On the other hand, the extension plates 47, 48 on the laterally opposite sides of the through-hole 44 are inserted in the third support hole 52 of the connector body 4 so that the press-fit projections 50 of each of the extension plates 47, 48 are fixably press-inserted in the third support hole 52. Therefore, the ground pin 22 is prevented from disengaging from the connector body 4 even if the pulling load is applied to the ground pin 22 from the board 20 side.

Figure 5A:
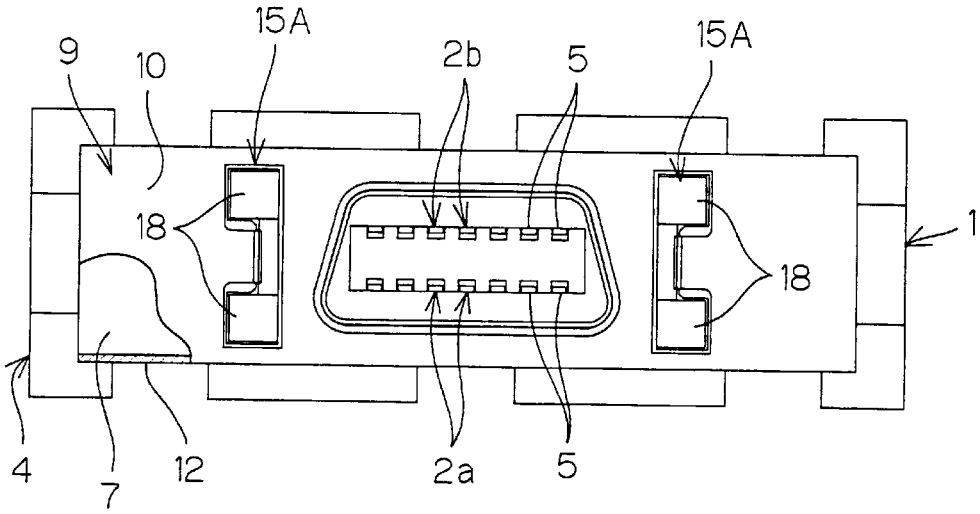
FIGS. 5A–5B are a plan view and a patially broken away side view showing a connector with ground pin according to a second embodiment hereof.
Figure 5B:
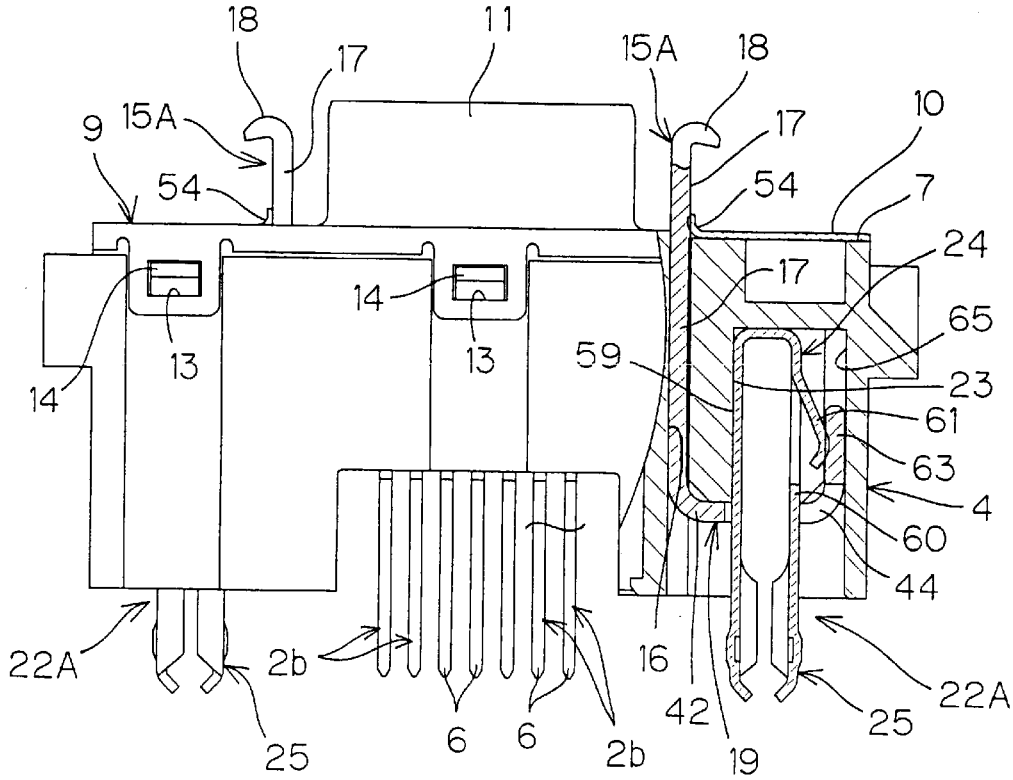
Figure 6:
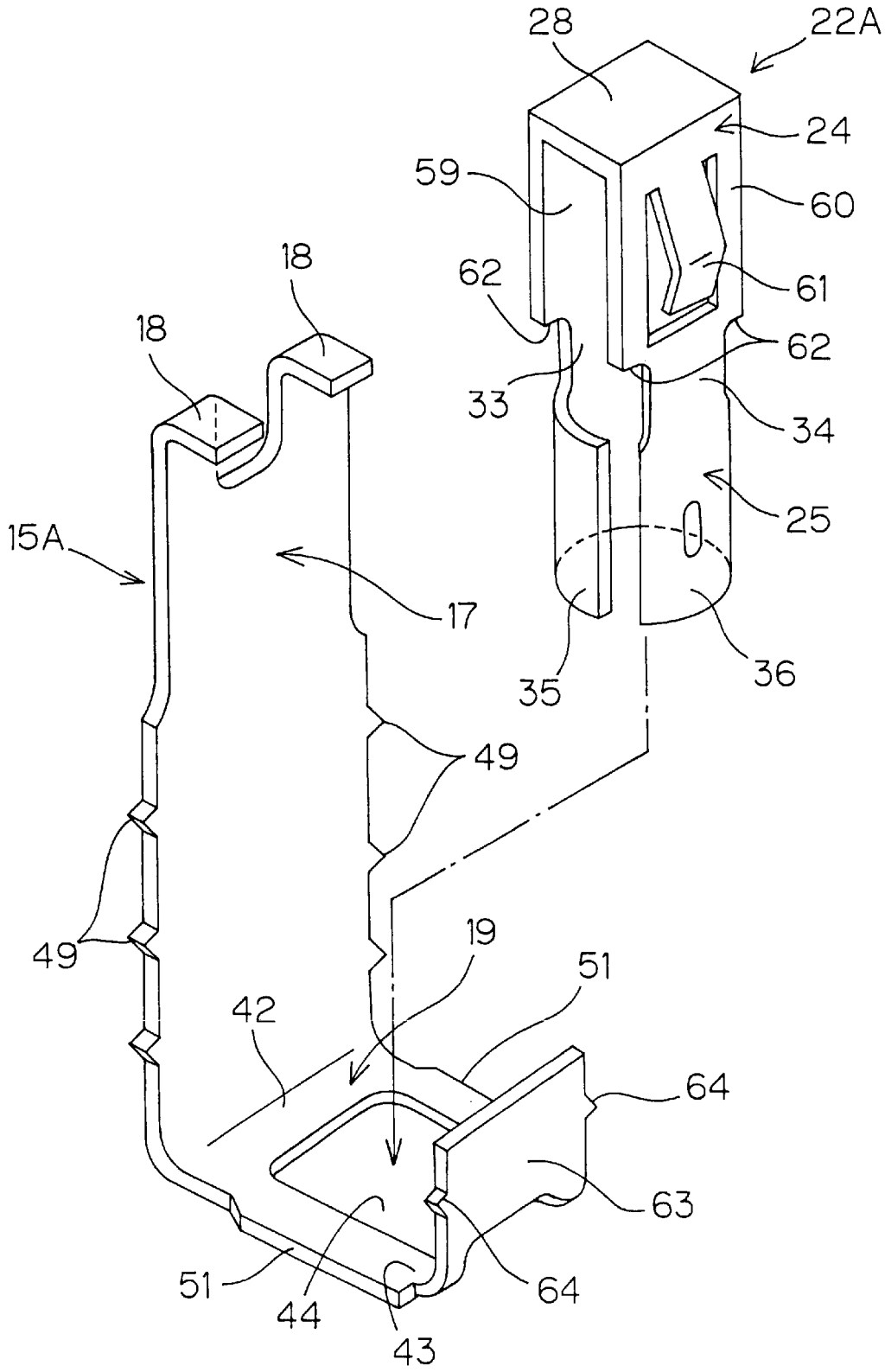
FIG. 6 is an exploded perspective view showing a ground pin and a locked member according to the second embodiment hereof.

Next, FIGS. 5A–5B and 6 illustrate a second embodiment of the invention. Referring to these figures, the second embodiment essentially differs from the first embodiment shown in FIGS. 1A–1B and 3 in the following points 1–4:

1) The first embodiment of FIG. 3 has the arrangement wherein the upper-plate portion 28 of the main body 24 of the ground pin 22 is formed with the opening 37 for insertion of the column 38 whereas the second embodiment dispenses with the opening 37 and the column 38. Instead, a ground pin 22A abuts against the bottom of the second support hole 23 substantially on the overall area of the upper-plate portion 28.
2) The first embodiment of FIG. 3 has the arrangement wherein the pair of side-wall portions 29, 30 of the ground pin 22 are arranged in a width-wise direction of the connector body 4, forming resilient contact pieces 40, 41 whereas the second embodiment is arranged such that a pair of side-wall portions 59, 60 of the ground pin 22A are arranged in a longitudinal direction of the connector body 4, and a resilient contact piece 61 is disposed at only one 60 of the side-wall portions.

3) The first embodiment of FIG. 3 has the arrangement wherein the pair of inward flanges 31, 32 of the main body 24 of the ground pin 22 are retained by the circumferential edge of the through-hole 44 of the locked member 15, whereas the second embodiment dispenses with the inward flanges 31, 32. Instead, a pair of steps 62 are formed between the side-wall portions 59, 60 of the main body 24 of the ground pin 22A and the corresponding extension pieces 33, 34 and are retained by the circumferential edge of the through-hole 44 of a locked member 15A.

4) The first embodiment of FIG. 3 has the arrangement wherein the pair of extension plates 47, 48 are formed on the laterally opposite sides of the through-hole 44, whereas the second embodiment dispenses with the pair of extension plates 47, 48. Instead, an extension plate 63 is extended from the second end 43 of the seat portion 19 in parallel with the arm 17, the extension plate 63 formed with press-fit projections 64 on opposite side edges thereof. The resilient contact piece 61 formed at the one side-wall portion 60 of the ground pin 22A resiliently contacts the extension plate 63 of the locked member 15A for ensuring the electrical conductivity between the locked member 15A and the ground pin 22A. The third support hole 52 for the extension plates 47, 48 is dispensed with. The extension plate 63 is fixably press-inserted in a third support hole 65.

Since the other parts are configured in the same way as in the first embodiment, such parts are represented by the same reference characters in the figures and the description thereof is dispensed with. The second embodiment also offers the same working-effects as the first embodiment. Besides, the second embodiment accomplishes the simplified configuration of the ground pin 22A and the further reduction of production costs by virtue of the elimination of the inward flanges and the provision of the resilient contact piece as a single element. In addition, the arm 17 and the extension plate 63 are disposed on opposite sides of the through-hole 44 to be press-inserted in the corresponding support holes 16, 65 of the connector body 4 so that the ground pin 22 is positively prevented from being pulled out despite the pulling load applied to the ground pin 22 from the board 20 side.

It is to be noted that the present invention is not limited to the foregoing embodiments and various changes and modifications may be made thereto within the scope of the invention.

What is claimed is:

1. A connector with a ground pin comprising:

an insulative connector body accommodating a plurality of contacts and having a top surface and an opposite bottom surface, the connector body including a first support hole, a second support hole and at least one third support hole formed into the bottom surface and being in communication with each other, the at least one third support hole extending through the top surface;

an electromagnetic shielding shell at least partially covering the top surface of the connector body;

a ground pin fabricated from metal and including a main body and a cylindrical lock portion integrally formed with the main body; and a locked member fabricated from metal and including an arm, a seat portion integrally connected perpendicularly to the arm and having a through hole formed therethrough and at least one extension plate integrally connected perpendicularly to the seat portion, wherein the cylindrical lock portion of the ground pin is slidably received through the through hole of the seat portion of the locked member so that the main body seats on and is in contact with the seat portion, the arm is slidably received through the first support hole to contact the electromagnetic shielding shell and is retained in the first support hole in a press-fit manner, the seat portion in contact and along with the main body of the ground pin is slidably received in the second support hole and the at least one extension plate is slidably received in the at least one third support hole and is retained therein in a press-fit manner with a portion of the main body in contact with the at least one extension plate.

2. The connector with a ground pin as claimed in claim 1, wherein the lock portion has a pair of slots, each slot defined by adjacent axially-extending edges of respective engaging segments.

3. The connector with a ground pin as claimed in claim 1, wherein the lock portion is formed with an outwardly projecting rib on its peripheral surface.

4. The connector with a ground pin as claimed in claim 1, wherein the locked member has a snag portion to be locked to an engagement portion of a counterpart connector in paired relation when the connector is coupled to the counterpart connector, and wherein the locked member contacts the shell and the ground pin for establishing electrical conductivity between the shell and the ground pin.

5. The connector with a ground pin as claimed in claim 1, wherein the main body is fixed in a support hole of the connector body, and the lock portion is extended from the main body.

6. The connector with a ground pin as claimed in claim 5, wherein the main body and the lock portion are formed integrally in one piece with sheet metal.

7. A connector with a ground pin for boards comprising:

an insulative connector body accommodating a plurality of contacts;

an electromagnetic shielding shell partially covering a surface of the connector body; and a ground pin fixed to the connector body as having electrical conductivity with the shell, wherein the ground pin includes a cylindrical lock portion resiliently deformable in a radial direction so as to be inserted through and locked to a mounting hole of a circuit board and a main body fixed in a support hole of the connector body, and wherein the lock portion resiliently engages almost an entire periphery of the mounting hole when inserted through the mounting hole and extends from the main body and wherein the ground pin including the main body and the lock portion is formed integrally in one piece with sheet metal and wherein the main body includes an upper-plate portion, a pair of side-wall portions opposed each other, and a pair of flanges individually extended inwardly from respective bottoms of the side-wall portions.

8. The connector with a ground pin for boards as claimed in claim 7, wherein the upper-plate portion of the main body of the ground pin includes an opening in which a column formed in the connector body is fitted, and wherein an end of the column abuts against the flange pair thereby positioning the ground pin.

9. The connector with a ground pin for boards as claimed in claim 7, wherein the ground pin further includes a pair of extension pieces extended substantially orthogonally from opposite ends of the flange pair and opposed each other.

10. The connector with a ground pin for boards as claimed in claim 9, wherein the pair of extension pieces include curved portions of a semi-circular arch in section which are opposed each other, and wherein the cylindrical lock portion includes the pair of curved portions of the extension pieces.

11. The connector with a ground pin for boards comprising:

an insulative connector body accommodating a plurality of contacts;

an electromagnetic shielding shell partially covering a surface of the connector body;

a ground pin fixed to the connector body as having electrical conductivity with the shell; and a locked member having a snag portion to be locked to an engagement portion of a counterpart connector in paired relation when the connector is coupled to the counterpart connector, wherein the ground pin includes a cylindrical lock portion resiliently deformable in a radial direction so as to be inserted through and locked to a mounting hole of a circuit board, and wherein the lock portion resiliently engages almost an entire periphery of the mounting hole when inserted through the mounting hole, and wherein the locked member contacts the shell and the ground pin for establishing electrical conductivity between the shell and the ground pin, wherein the ground pin further includes a main body fixed in a support hole of the connector body;

wherein the lock portion is extended from the main body;

wherein the locked member includes a press-fit portion, a seat portion and an arm;

wherein the press-fit portion is press-inserted in the support hole;

wherein the seat portion engages the main body of the ground pin for fixing the main body in the support hole; and wherein the arm extends orthogonally from an end of the seat portion and has the snag portion at its distal end.

12. The connector with a ground pin for boards as claimed in claim 11, wherein the connector body includes a coupling surface to a counterpart connector in paired relation, and a cylinder portion projecting from the coupling surface to accommodate respective one-end portions of the plural contacts;

wherein the shell includes a base covering at least a part of the coupling surface of the connector body, and a cylindrical portion upstanding from the base for covering an outside surface of the cylinder portion of the connector body;

wherein the base of the shell is formed with an opening permitting the insertion of the arm of the locked member therethrough; and wherein a resilient piece extended from a circumferential edge of the opening of the shell resiliently contacts the arm, thereby establishing electrical conductivity between the shell and the locked member.

13. The connector with a ground pin for boards as claimed in claim 11, wherein a through-hole is formed in the seat portion of the locked member at a place away from the end of the seat portion for permitting the lock portion of the ground pin to be inserted therethrough.

14. The connector with a ground pin for boards as claimed in claim 13, the main body of the ground pin is retained by a circumferential edge of the through-hole of the seat portion for restriction of the removal of the main body from the support hole.

15. The connector with a ground pin for boards as claimed in claim 14, wherein a pair of extension plates are extended from side edges of the seat portion on laterally opposite sides of the through-hole and in the same direction as the arm does, the extension plate pair cooperating with the seat portion to define a channel shape.

16. The connector with a ground pin for boards as claimed in claim 15, wherein the pair of extension plates each include the press-fit portion.

17. The connector with a ground pin for boards as claimed in claim 15, wherein the ground pin includes a resilient contact piece resiliently contacting at least one of the extension plate pair.

* * * * *